US005967217A

United States Patent [19]

Wu

[11] Patent Number: 5,967,217

[45] Date of Patent: Oct. 19, 1999

[54] AUTO/MANUAL DUAL/MODE CURTAIN TRACK ASSEMBLY

[76] Inventor: King-Sheng Wu, FL. 12, No. 47, Chin-Hwa Street, Taipei, Taiwan

[21] Appl. No.: 09/162,362

[22] Filed: Sep. 29, 1998

[51] Int. Cl.[6] ..... A47H 5/02

[52] U.S. Cl. ..... 160/331

[58] Field of Search ..... 160/331, 330, 160/345, 123, 126, 168.1 P, 84.02, DIG. 17

[56] References Cited

U.S. PATENT DOCUMENTS

| | | | |
|---|---|---|---|
| 3,136,358 | 6/1964 | Madsen | 160/331 |
| 3,327,194 | 6/1967 | Trapp | 160/331 X |
| 3,370,639 | 2/1968 | Brimer | 160/331 |
| 3,374,823 | 3/1968 | Ford | 160/331 |
| 3,531,666 | 9/1970 | Ford | 160/331 X |
| 4,437,506 | 3/1984 | Ogita | 160/331 |
| 4,839,544 | 6/1989 | Sakai | 160/331 X |

*Primary Examiner*—David M. Purol
*Attorney, Agent, or Firm*—Bacon & Thomas, PLLC

[57] ABSTRACT

An auto/manual dual-mode curtain rack assembly includes a casing, a movable rack, a plurality of carrier slides, and a driving unit, wherein the casing defining a first track and a second track below the first track; the movable rack is moved along the first track and has at least one magnetic member mounted on a flexible rack body; the carrier slides are moved along the second track to carry a curtain, and have at least one magnetic member provided at least one carrier slide, the at least one magnetic member of the carrier slides being attractive to the magnetic member at the movable rack; the driving unit includes a reversible motor and a gear meshed with the movable rack and driven by the reversible motor to move the movable rack along the first track.

7 Claims, 3 Drawing Sheets

AUTO/MANUAL DUAL/MODE CURTAIN TRACK ASSEMBLY

BACKGROUND OF THE INVENTION

The present invention relates to curtain track means, and more particularly to an auto/manual dual-mode curtain track assembly for use in a window, examination room, sickroom, bath room, etc.

A regular curtain track assembly is generally comprised of a plurality of carrier slides moved along a track to carry a curtain, and a cord pulled to move the carrier slides in closing/opening the curtain. People may directly pull the curtain by hand between the closed position and the opened position. When pulling the curtain directly by hand or pulling the cord to close/open the curtain with abnormal force, the cord or the rollers of the carrier slides may be damaged. To a sick person, it is inconvenient to get off the sickbed and then to close/open the curtain. Furthermore, directly touching the curtain or the cord may cause a contamination.

SUMMARY OF THE INVENTION

It is one object of the present invention to provide a curtain track assembly which can be operated automatically as well as manually. It is another object of the present invention to provide an auto/manual dual-mode curtain track assembly which has an outer appearance similar to a regular conventional curtain track assembly, and is safe in use without causing an electric shock or mechanical damage when operated. It is still another object of the present invention to provide an auto/manual dual-mode curtain track assembly which can easily be operated by a sick person without the assistance of other people. It is still another object of the present invention to provide an auto/manual dual-mode curtain track assembly which prevents a direction touch of the hand to the curtain, and effectively eliminates a contamination. According to one aspect of the present invention, the auto/manual dual-mode curtain track assembly comprises a casing, a movable rack, a plurality of carrier slides, and a driving unit. The casing is an elongated member defining a first track and a second track below the first track. The first track has a top opening at its top side wall, and a longitudinal bottom slot at its bottom side wall. The second track has a longitudinal slot at its bottom side wall. The movable rack is moved along the first track, comprising a flexible rack body and at least one magnetic means mounted on the rack body. The rack body has a toothed portion longitudinally disposed at its top side. The carrier slides are moved along the second track and adapted to carry a curtain. The carrier slides includes at least one mounted with magnetic means attractive to the magnetic means of the movable rack. The driving unit is fixedly disposed adjacent to the top opening of the first track, comprising a reversible motor and a gear meshed with the toothed portion of the rack body of the movable rack and driven by the reversible motor to move the movable rack along the first track. When the reversible motor is controlled to turn in one direction, the gear is rotated to move the movable rack along the first track, causing the magnetic means of the carrier slides to be attracted by the magnetic means of the movable rack and moved with the magnetic means of the movable rack in closing/opening the curtain. When the curtain is pull by hand to move the magnetic means of the carrier slides away from the constraint of the magnetic attractive force of the magnetic means of the movable rack, the curtain is allowed to be closed/opened manually. Because the operator does not touch the curtain directly when opening/closing it, no contamination problem occurs. Besides, it is safe in use without causing an electric shock or mechanical damage when operated. According to another aspect of the present invention, the flexible rack body of the movable rack has two longitudinal rows of pegs at two opposite sides respectively supported in the first track at two opposite sides of the longitudinal bottom slot of the first track. Alternatively, rollers may be provided at two opposite sides of the rack body of the movable rack to guide the movement of the movable rack along the first track. According to still another aspect of the present invention, the first track and the second track of the casing are extruded from aluminum in integrity. Alternatively, the first track and the second track of the casing may be made respectively, and then are mounted together with each other. Furthermore, the driving unit can be controlled by a cable. Additionally, a remote controller may be used to control the operation of the driving unit from a distance. Induction switch means may be used to automatically cut off power supply from the reversible motor when the curtain is moved to the closed or opened position. The induction switch means can be magnetic switch means, photoelectric switch means, mechanical switch means, etc.

DETAILED DESCRIPTION OF THE PREFERRED EMBODIMENT

Figure 1:
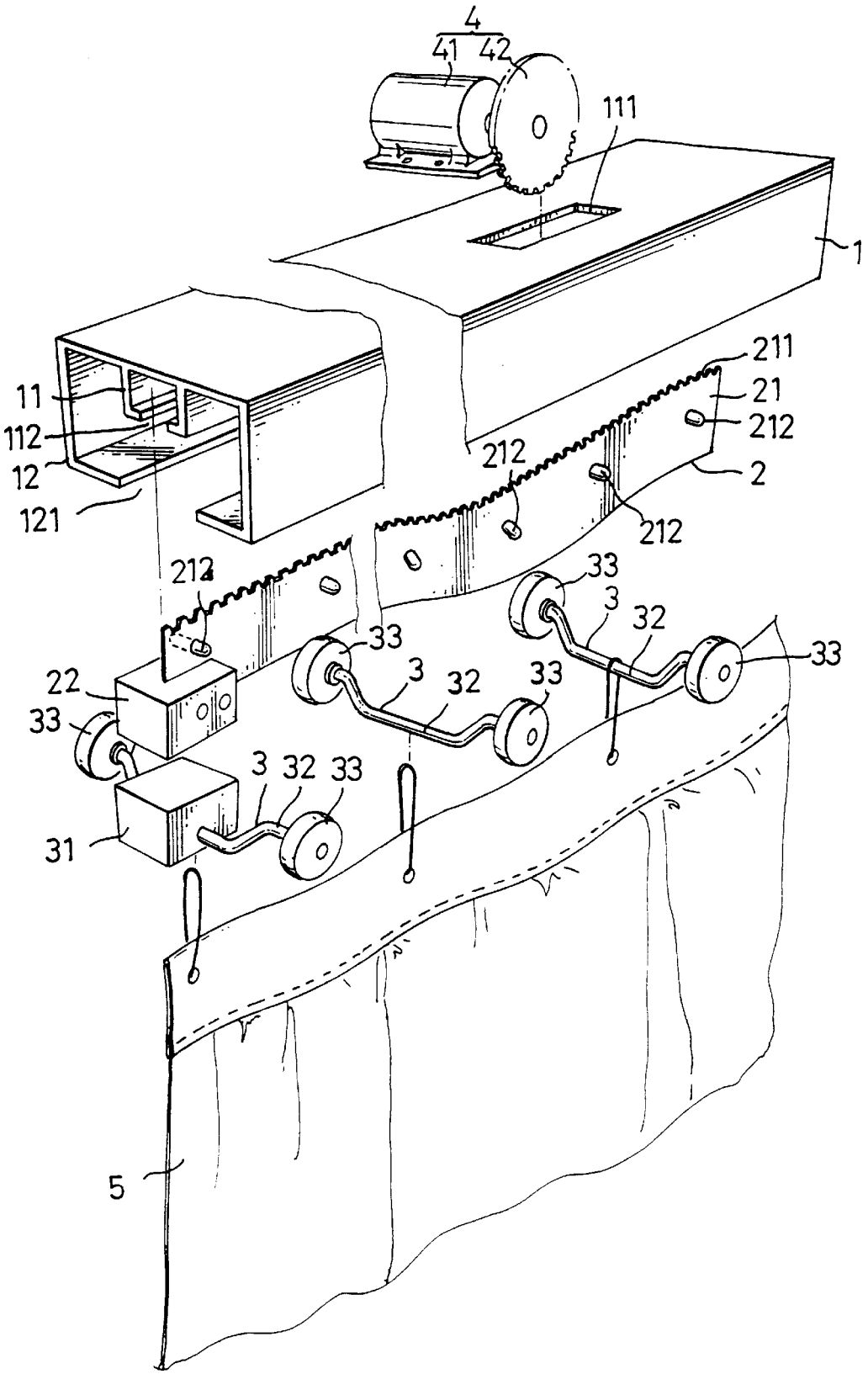
FIG. 1 is an exploded view of an auto/manual dual-mode curtain track assembly according to a first embodiment of the present invention.
Figure 2:
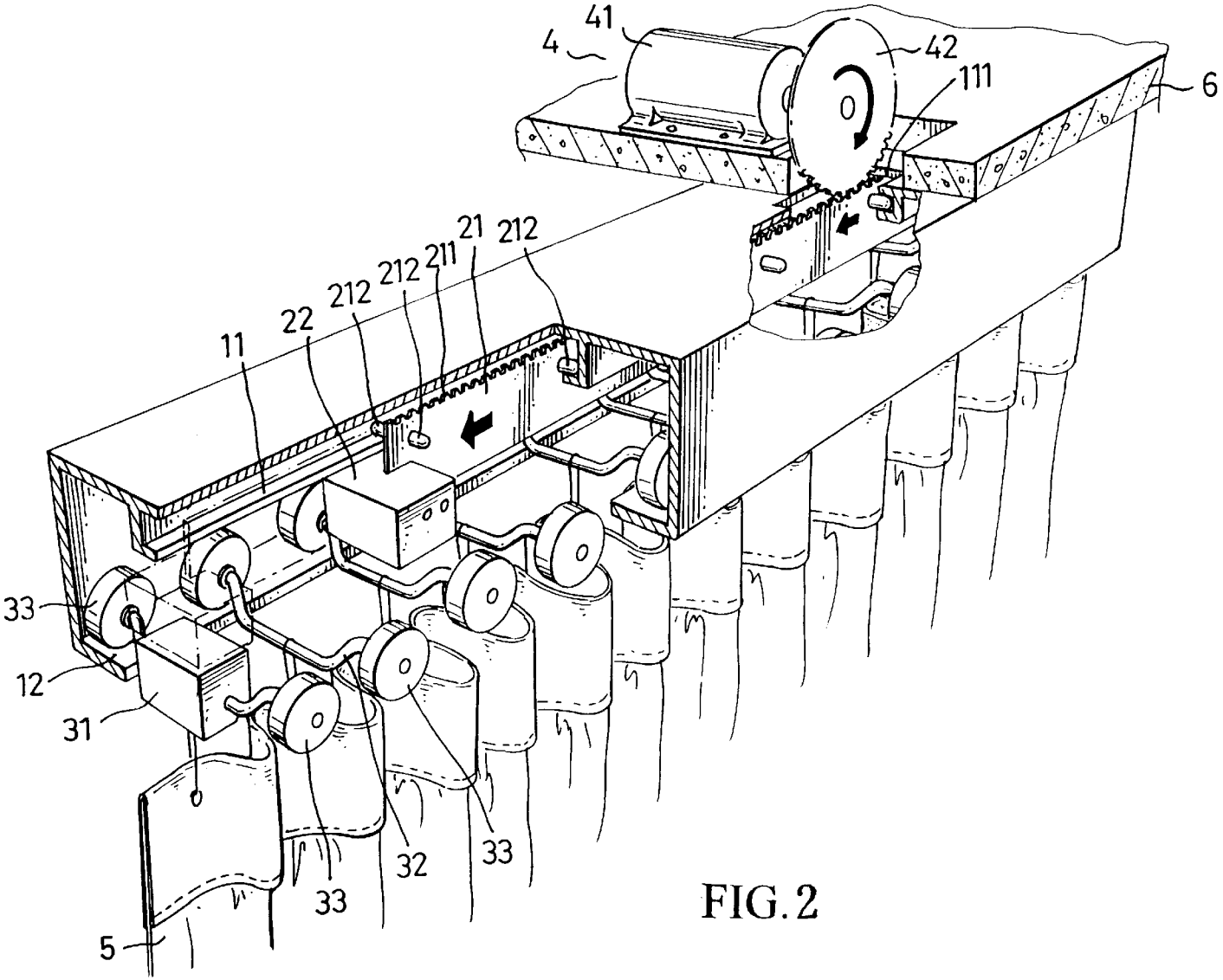
FIG. 2 shows the auto/manual dual-mode curtain track assembly of the first embodiment of the present invention operated.

Referring to FIGS. 1 and 2, an auto/manual dual-mode curtain track assembly in accordance with the present invention is generally comprised of a casing 1, a movable rack 2, a plurality of carrier slides 3, and a driving unit 4.

The casing 1 is an axially extended member extruded from aluminum, and fixedly mounted along the top of a wall below a ceiling 6. The casing 1 is comprised of a first track 11, and a second track 12. The first track 11 has a top opening 111 at its top wall, and a longitudinal bottom slot 112 at its bottom wall. The second track 12 is disposed below the first track 11, having a longitudinal bottom slot 121 at the bottom wall. The movable rack 2 is moved in the first track 11, comprised of a flexible rack body 21, and a magnetic member 22. The flexible rack body 21 is a narrow, elongated sheet member having two longitudinal rows of pegs 212 at two opposite sides, and a toothed portion 211 longitudinally disposed at the top. The pegs 212 each have a smoothly curved end. The magnetic member 22 is fixedly mounted on one end, namely, the front end of the rack body 21. The flexible rack body 21 is inserted through the longitudinal bottom slot 112 of the first track 11, and the pegs 212 of the flexible rack body 21 are supported inside the first track 11.

Referring to FIG. 2 again, the carrier slides 3 are respectively mounted in the second track 12. Each carrier slide 3 is comprised of a shaft 32, and two rollers 33 mounted on the ends of the shaft 32. The rollers 33 of the carrier slides 3 are moved in the second track 12 at two opposite sides of the longitudinal bottom slot 121. A curtain 5 is hung on the shafts 33 of the carrier slides 3. A magnetic member 31 is fixedly mounted on the shaft 33 of the first carrier slide 3.

Referring to FIG. 2 again, the driving unit 4 comprises a reversible motor 41 fixedly mounted on the ceiling 6 above the top opening 111, and a gear 42 fixedly mounted on the output shaft of the reversible motor 41 and peripherally inserted through the top opening 111 into engagement with the toothed portion 211 of the movable rack 2.

Referring to FIG. 2 again, when the reversible motor 41 is started to turn the gear 42 in one direction, the movable rack 2 is driven by the gear 42 to move along the first track 11. When the magnetic member 22 of the movable rack 2 is moved close to the magnetic member 31 at the first carrier slide 3, the magnetic member 31 at the first carrier slide 3 is attracted by the magnetic member 22 of the movable rack 2 by magnetic attraction. Therefore, when the magnetic member 22 is continuously moved forwards with the movable rack 2 in the first track 11, the carrier slides 3 are moved in the same direction to spread out of the curtain 5. On the contrary, when the reversible motor 41 is rotated in the reversed direction, the curtain 5 is received. When the curtain 5 is pulled by hand to release the magnetic member 31 at the first carrier slide 3 from the magnetic attractive force of the magnetic member 22 of the movable rack 2, the curtain 5 can then be manually pulled or pushed between the spread out position and the received position. Because the driving unit 4 is installed in the ceiling 6, the whole assembly of the curtain track assembly looks like a regular conventional curtain track assembly. When the curtain track assembly is used in an examination room or sickroom in a hospital, the doctor or nurse can close or open the curtain without touching it.

Figure 3:
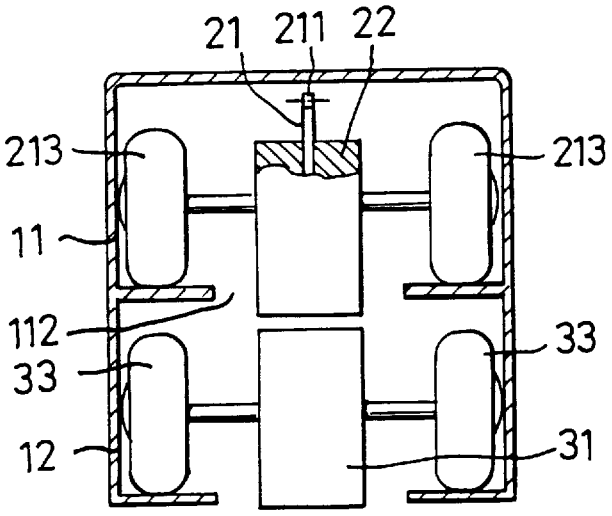
FIG. 3 is a sectional view of a part of an auto/manual dual-mode curtain track assembly according to a second embodiment of the present invention.

FIG. 3 shows an auto/manual dual-mode curtain track assembly according to a second embodiment of the present invention. According to this embodiment, the first track 11 has a relatively greater cross section, and the flexible rack body 21 has two longitudinal rows of rollers 213 are two opposite sides. By means of the rollers 213, the flexible rack body 21 can be moved along the first track 11 smoothly.

Figure 4:
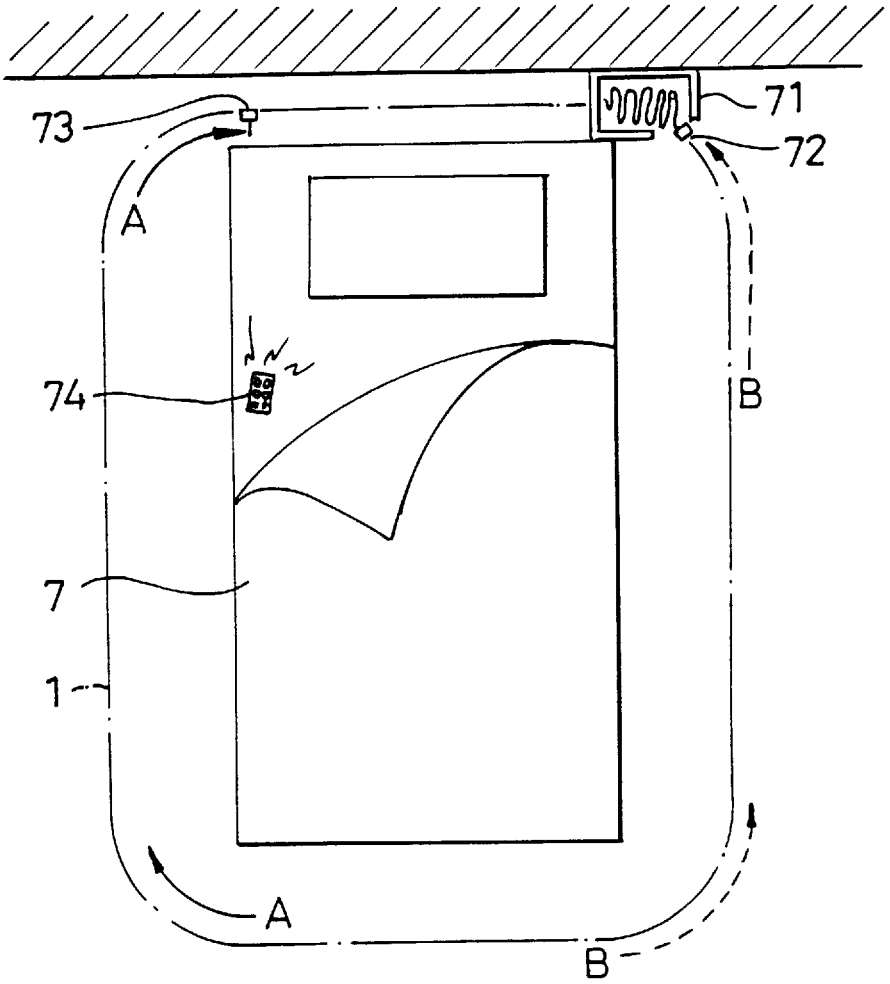
FIG. 4 shows an application example of the present invention.

FIG. 4 shows an auto/manual dual-mode curtain track assembly according to a third embodiment of the present invention. According to this embodiment, the casing 1 is shaped like a loop arranged on the ceiling 6 around the sickbed 7. The sickbed 7 has a storage box 71 at one side of its head. The casing 1 is mounted with an induction switch 72 at a locating corresponding to the storage box 71. Another induction switch 73 is provided at the head of the sickbed 7 remote from the storage box 71. The induction switches 72,73 are photo induction switches. The reversible motor 41 can be controlled by a remote controller 74 to move the movable rack 2 along the first track 11. When the remote controller 74 is operated to turn the reversible motor 41 clockwise, the magnetic member 31 is moved with the magnetic member 22, causing the curtain 5 to be moved forwards (in direction A), and therefore the sickbed 7 is surrounded by the curtain 5. When the magnetic member 22 reaches the induction switch 73, the induction switch 73 is triggered to cut off power supply from the reversible motor 41, and therefore the curtain 5 is stopped in place. When the reversible motor 41 is controlled to rotate in the reversed direction, the magnetic member 31 is moved with the magnetic member 22, causing the curtain 5 to be moved backwards (in direction B), and therefore the curtain 5 is received in the storage box 71. When the curtain 5 is received, the induction switch 72 is triggered by the magnetic member 22 to cut off power supply from the reversible motor 41.

What the invention claimed is:

1. An auto/manual dual-mode curtain track assembly comprising:

an axially extended casing defining a first track and a second track below said first track, said first track having a top opening at a top side wall thereof and a longitudinal bottom slot at a bottom side wall thereof, said second track having a longitudinal slot at a bottom side wall thereof;

a movable rack moved along said first track, said movable rack comprising a flexible rack body and at least one magnetic means mounted on said rack body, said rack body having a toothed portion longitudinally disposed at a top side thereof;

a plurality of carrier slides moved along said second track and adapted to carry a curtain, said carrier slides including at least one mounted with magnetic means attractive to the magnetic means of said movable rack; and a driving unit fixedly disposed adjacent to the top opening of said first track, said driving unit comprising a reversible motor and a gear meshed with said toothed portion of said rack body of said movable rack and driven by said reversible motor to move said movable rack along said first track;

wherein when said reversible motor is controlled to turn in one direction, said gear is rotated to move said movable rack along said first track, causing the magnetic means of said carrier slides to be attracted by the magnetic means of said movable rack and moved with the magnetic means of said movable rack in closing/opening the curtain; when the curtain is pull by hand to move the magnetic means of said carrier slides away from the constraint of the magnetic attractive force of the magnetic means of said movable rack, the curtain is allowed to be closed/opened manually.

2. The auto/manual dual-mode curtain track assembly of claim 1 wherein the flexible rack body of said movable rack has two longitudinal rows of pegs at two opposite sides respectively supported in said first track at two opposite sides of the longitudinal bottom slot of said first track.

3. The auto/manual dual-mode curtain track assembly of claim 1 wherein the flexible rack body of said movable rack has a plurality of rollers longitudinally aligned in two rows at two opposite sides and respectively supported in said first track at two opposite sides of the longitudinal bottom slot of said first track.

4. The auto/manual dual-mode curtain track assembly of claim 1 wherein said carrier slides each comprise a shaft, and two rollers respectively mounted on two opposite ends of said shaft and moved along said second track at two opposite sides of the longitudinal bottom slot of said second track.

5. The auto/manual dual-mode curtain track assembly of claim 1 wherein said first track and said second track of said casing are integrally extruded from aluminum.

6. The auto/manual dual-mode curtain track assembly of claim 1 wherein said driving unit is controlled by a remote controller.

7. The auto/manual dual-mode curtain track assembly of claim 1 further comprising at least one induction switch, which is triggered to turn off said driving unit when the magnetic means of said movable rack is moved to a predetermined position.

* * * * *